United States Patent [19]

Stockman

[11] 4,219,069

[45] Aug. 26, 1980

[54] QUICK RELEASE FOR SECTOR PLATE

[75] Inventor: Richard F. Stockman, Friendship, N.Y.

[73] Assignee: The Air Preheater Company, Inc., Wellsville, N.Y.

[21] Appl. No.: 44,281

[22] Filed: May 31, 1979

[51] Int. Cl.[3] ..... F28D 19/04

[52] U.S. Cl. ..... 165/9; 74/2; 74/97

[58] Field of Search ..... 165/9; 74/2, 97

[56] References Cited

U.S. PATENT DOCUMENTS 3,669,183 6/1972 Mock ..... 165/9

3,786,868 1/1974 Finnemore ..... 165/9

*Primary Examiner*—Albert W. Davis

*Attorney, Agent, or Firm*—Wayne H. Lang

[57] ABSTRACT

Rotary regenerative heat exchange apparatus including a housing that surrounds a rotor of heat absorbent material. A pair of oppositely spaced sector plates intermediate the ends of the rotor and the rotor housing are subjected to a force biasing them to conform to thermal deformation of the rotor to preclude leakage of fluid therebetween. A mechanism is provided whereby the sector plates are quickly released from the biasing force to preclude interference between the rotor and the sector plates.

5 Claims, 3 Drawing Figures

QUICK RELEASE FOR SECTOR PLATE

BACKGROUND OF THE INVENTION

In rotary regenerative heat exchange apparatus a mass of heat absorbent element commonly comprised of packed element plates is first positioned in a hot gas passageway to absorb heat from hot gases passing therethrough. After the plates become heated by the hot gases they are moved to a passageway for cooler fluid where the heated plates transmit the absorbed heat to cool air or other fluid passing therethrough.

The heat absorbent plates are carried in a rotor that rotates between hot and cool fluids while housing structure including apertured sector plates at opposite ends of the rotor is adapted to surround the rotor. To prevent leakage and the mingling of the hot and cool fluids, the end edges of the rotor are provided with flexible sealing members that rub against the adjacent parts of the rotor housing to resiliently accommodate a limited amount of "turndown" or other distortion caused by mechanical loading and thermal deformation of the rotor.

To permit turning the rotor freely about its axis, certain minimum clearance space between the rotor and the confronting parts of the rotor housing is required, however, excessive clearance is to be avoided because it will dictate excessive fluid leakage. However, under transient conditions marked by a rapid change of temperature and expansion of the rotor and the rotor housing, excessive leakage may develop and a lower effectiveness will result.

The expansion of the rotor and the adjacent housing structure assumes maximum proportions directly adjacent the inlet for the hot fluid where the temperature is the maximum. An arrangement that compensates for a loss of sealing effectiveness at this, the "hot end" of a rotor, is shown by U.S. Pat. No. 3,786,868 where a plane sector plate is pivoted about a fulcrum carried by the housing. A later U.S. Pat. No. 4,124,063 permitted reduced leakage by providing a sector plate that was forced to arcuately deform in accordance with the thermal deformation being experienced by the rotor. Although such an arrangement may be effective for normal operating conditions, a rapid change of temperature may cause a differential of expansion between the rotor and the rotor housing whereby there will be interference of one with the other causing excessive wear and degradation of abutting surfaces.

SUMMARY OF THE INVENTION

In accordance with my invention, I therefore propose to provide a quick release mechanism for a rotary regenerative air preheater in which a sector plate that is adapted to conform closely to thermal distortion of the rotor may be quickly "backed off" from a sealing relationship therewith whereby a sudden change in temperature that determines the positioning of the rotor will not effect interference therebetween.

BRIEF DESCRIPTION OF THE DRAWING

A more complete understanding of my invention may be realized by referring to the following description in conjunction with the accompanying drawing in which.

DESCRIPTION OF THE PREFERRED EMBODIMENT

Figure 1:
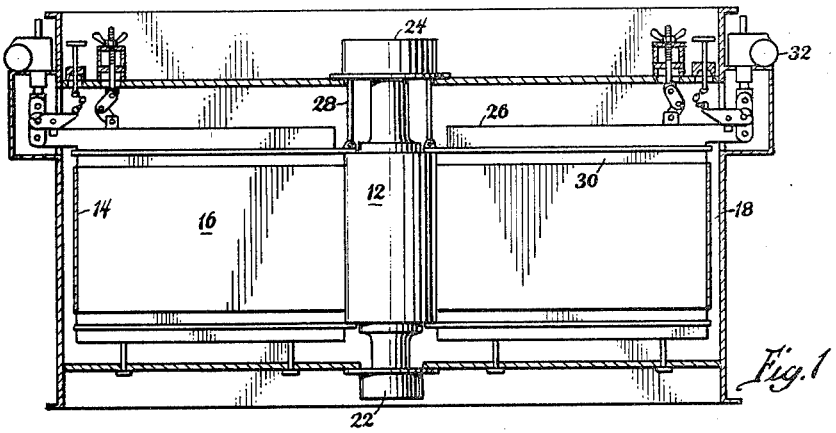
FIG. 1 is a cross section of a rotary regenerative heat exchanger involving the present invention.

The heat exchanger has a rotor that includes a rotor post 12 and a concentric rotor shell 14 spaced therefrom to provide an annular space therebetween that is filled with a mass of permeable heat absorbent element 16. The rotor of heat absorbent element is rotated slowly about its axis by a drive mechanism whereby it may absorb heat from a heating fluid passing through one side and transfer it to a fluid to be heated passing through the opposite side thereof.

The hot gas or other heating fluid enters the heat exchanger through an inlet duct and is discharged after traversing the heated material 16 through a spaced outlet duct. Cool air or other fluid to be heated enters the heat exchanger through an inlet duct and is discharged after flowing over the heated material 16 through an outlet duct to which an induced draft fan is usually connected. After passing over the heated material the cool air absorbs heat therefrom and is then directed to a place of ultimate use.

A cylindrical housing encloses the rotor in spaced relation thereto to provide an annular space 18 therebetween. Sector plates 26 intermediate ends of the rotor and the adjacent housing structure lie intermediate spaced apertures that admit and discharge the streams of gas and air. In order that the streams of gas and air do not bypass the rotor, it is customary to affix flexible sealing means 30 to the end edge of the rotor to confront the adjacent surface of the rotor housing to preclude the flow of fluid therebetween.

In a standard heat exchanger of the type herein defined, the hot has enters the top of the heat exchanger and transfers its sensible heat to the heat absorbent material of the rotor before it is discharged as cool gas from an outlet duct. Inasmuch as the inlet for the cool air lies at the bottom of the heat exchanger adjacent the cool gas inlet, the bottom of the heat exchanger is termed the "cold" end while that lying adjacent the hot gas inlet is called the "hot" end. It will be evident that the "hot" end of the rotor is subject to maximum thermal variation while the "cold" end is being subjected to a lesser amount.

Thus maximum thermal expansion of the rotor housing and the adjacent end of the enclosed rotor occurs at the top of the rotor, adjacent the inlet for the hot gas or other fluid, at what is called the "hot" end to cause rotor expansion similar to that of an inverted dish called rotor "turndown". The result of this relative expansion of the rotor and the surrounding rotor housing is to cause an increase of clearance space therebetween and an increase of fluid leakage between relatively movable parts, and a lowering of efficiency.

A lower support bearing 22 is mounted rigidly on structure that supports the central rotor post 12 for rotation about its vertical axis while an upper guide bearing 24 supported by the rotor housing precludes lateral movement of the rotor but moves vertically with the expansion of the rotor post.

According to the current state of the art, the inner end of a sector plate 26 is supported by hangers 28 pivotally supported by the axially movable guide bearing. The outer end of sector plate 26 is then forced to assume a dished configuration that conforms essentially to the adjacent face of the rotor wherein the radial inboard end of the sector plate remains essentially flat while the outboard end thereof is forced down by the drive means 32.

Means that forces the sector plate to assume a configuration similar to that of the adjacent end of the rotor is disclosed in my previous invention, now U.S. Pat. No. 4,124,063. According to this patent, a close relationship between the rotor and the rotor housing is constantly maintained to permit a minimum of fluid leakage therebetween.

At times, however, when the heat exchanger is subjected to rapidly varying temperatures, there may be a sudden variation in rates of expansion between the rotor and adjacent sector plate whereby there is interference therebetween. Therefore the seals or other parts of the rotor that are adapted to operate essentially friction-free are now subjected to excessive wear.

To avoid excessive wear, this invention is directed to an arrangement whereby a hinged sector plate that has been forcibly deformed to conform with the conformation of the rotor may be quickly released to assume an independent status, free from the rotor or other moving parts, whereby there will be little or no chance of mutual interference and excessive wear.

Figure 2:
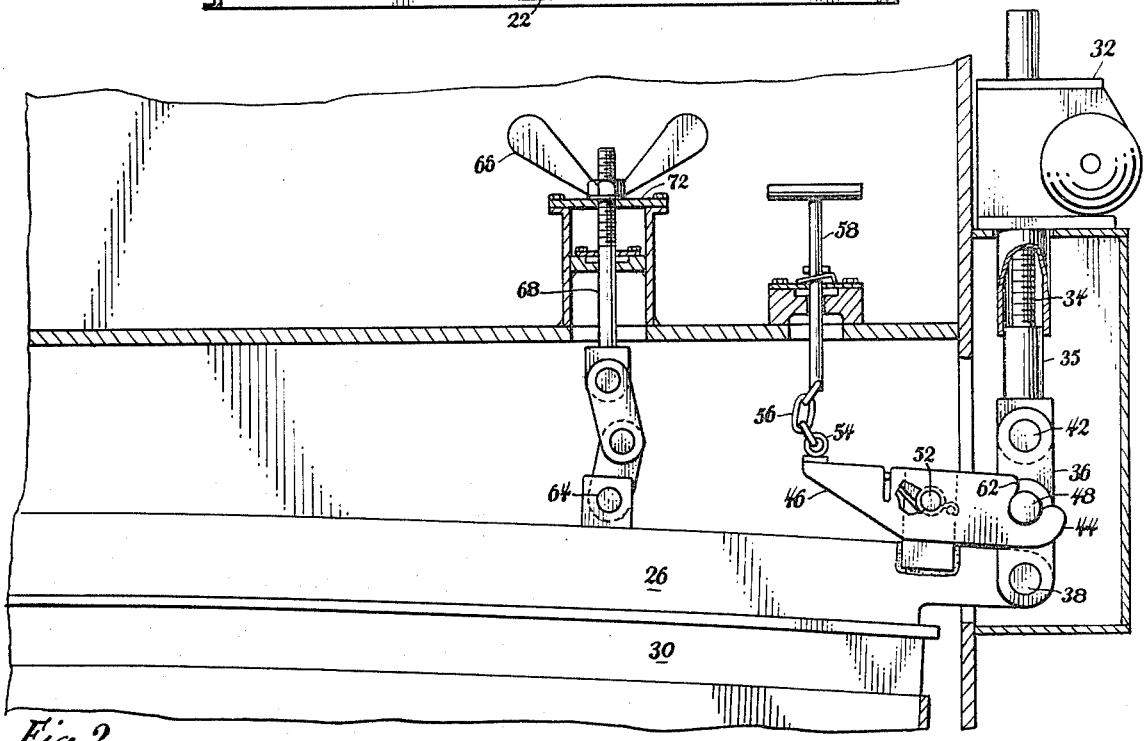
FIG. 2 is an enlarged section showing the details of the quick release mechanism in a sealing relationship.

According to this invention the drive means 32 includes a screw drive 34 moving a linkage up or down according to the rotation of means 34. The linkage 36 is pivotally attached by pin 38 to the outer end of the sector plate 26 whereby said sector plate is forced to assume a curved position that confronts the adjacent face of the rotor to preclude fluid flow therebetween in the conventional manner shown by FIG. 2.

The screw drive 34 comprises an extension to shank 35 that is pivotally secured to the upper end of linkage 36 by a pivot 42 whereby forces of tension or compression may be applied longitudinally through aligned linkage members 36 to the end of sector plate 26.

Figure 3:
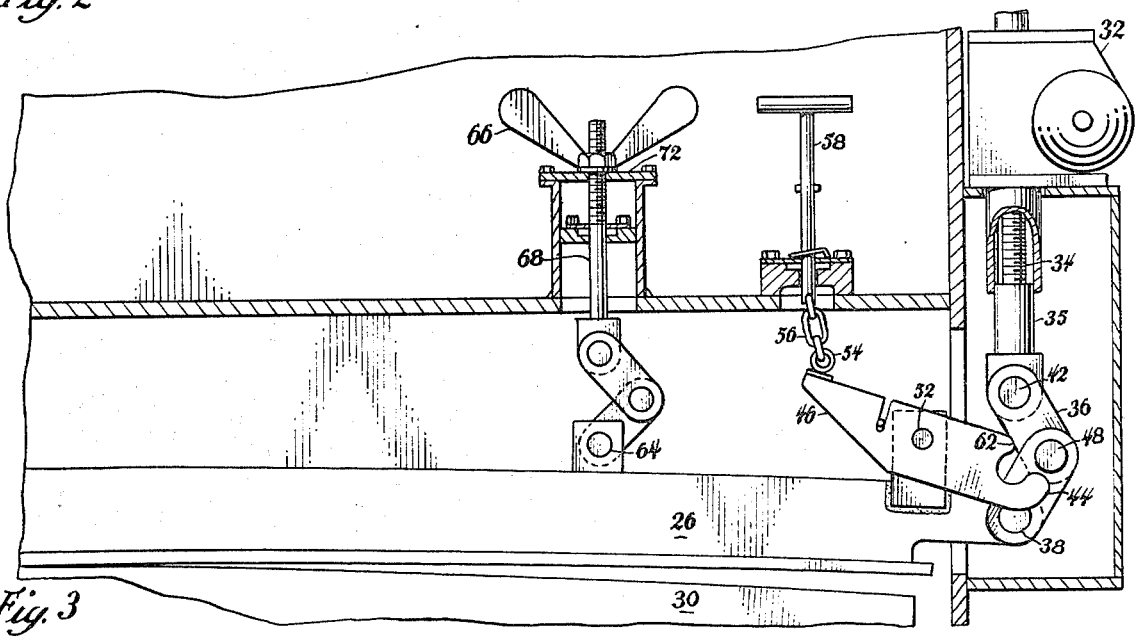
FIG. 3 is an enlarged section showing the quick release mechanism after actuation.

A hook 44 in lever 46 is adapted to hold central pivot pin 48 in alignment with pivot pins 38 and 42 at opposite ends of linkage 36. The hook is at the end of lever 46 that itself is pivoted at 52 to a support mounted on the sector plate 26. At the end of lever 46, opposite hook 44, is an eye 54 to which a tension chain 56 is secured. An opening in the end plate vertically above the eye 54 receives an end of the chain for attachment to a hand actuator 58 which, when manually raised, rotates the lever 46 clockwise to release the hook 44 from pin 48. As the hook is released from the pin, shoulder 62 moves pin 48 out of axial alignment so the pivots 38 and 42 can move toward one another and allow the sector plate 26 to separate from the seals 30 at the end of the rotor in the manner shown by FIG. 3.

An emergency lifting linkage on sector plate 26 is provided to move the sector plate 26 upward and away from the adjacent end of the rotor, if rotation of lever 46 does not permit automatic movement thereof. Accordingly, a hand rotated nut 66 is threadably attached to a longitudinal bolt 68 that acts upon shoulder 72 to raise the linkage attached at 64 to sector plate 26.

What is claimed is:

1. Rotary regenerative heat exchange apparatus having a rotor including a central rotor post and a concentric rotor shell spaced therefrom to provide an annular space therebetween, a mass of heat absorbent material carried in the annular space between the rotor post and the rotor shell, a housing surrounding the rotor in spaced relation having inlet and outlet ducts at opposite ends thereof for a heating fluid and for a fluid to be heated, support means adapted to support the rotor for rotation about its axis, a guide bearing at the opposite end of the rotor adapted to preclude radial movement of the rotor post, means for rotating the rotor about its axis, a sector plate intermediate the end of the rotor and the rotor housing adapted to maintain the heating fluid separate from the fluid to be heated, support means movable in accordance with axial expansion of the rotor post adapted to support the sector plate at a point adjacent the inboard end thereof, actuating means at the outboard end of the sector plate adapted to deform the sector plate into a curvilinear shape that corresponds to the profile of the rotor, linkage means connecting the actuating means to the sector plate, and a quick release mechanism interposed in said linkage means permitting the actuating means to be operatively detached from the sector plate.

2. Rotary regenerative heat exchange apparatus as defined in claim 1 wherein the linkage mechanism comprises a plurality of links that have fixed pivots at opposite ends thereof and a laterally movable center pivot therebetween.

3. Rotary regenerative heat exchange apparatus as defined in claim 2 wherein the quick release includes a latch mechanism that holds center pivot in alignment with the end pivots.

4. Rotary regenerative heat exchange apparatus as defined in claim 3 wherein the quick release mechanism includes an emergency actuator mounted on said housing, and means connecting the emergency actuator to said latch to permit the release thereof from a position outside said housing.

5. Rotary regenerative heat exchange apparatus as defined in claim 4 including a manual lift screw mounted on said housing vertically spaced above said sector plate, and means connecting the manual lift screw to the sector plate to permit raising the sector plate away from the adjacent end of the rotor.

* * * * *